US007902904B2

(12) United States Patent
Kumar et al.

(10) Patent No.: US 7,902,904 B2
(45) Date of Patent: Mar. 8, 2011

(54) BIAS CIRCUIT SCHEME FOR IMPROVED RELIABILITY IN HIGH VOLTAGE SUPPLY WITH LOW VOLTAGE DEVICE

(75) Inventors: Pankaj Kumar, Karnataka (IN); Makeshwar Kothandaraman, Whitehall, PA (US); Dipankar Bhattacharya, Macungie, PA (US); John Kriz, Palmerton, PA (US); Jeffrey J. Nagy, Allentown, PA (US); Pramod Elamannu Parameswaran, Bangalore (IN)

(73) Assignee: LSI Corporation, Milpitas, CA (US)

( * ) Notice: Subject to any disclaimer, the term of this patent is extended or adjusted under 35 U.S.C. 154(b) by 176 days.

(21) Appl. No.: 12/330,828

(22) Filed: Dec. 9, 2008

(65) Prior Publication Data

US 2010/0141334 A1 Jun. 10, 2010

(51) Int. Cl.
*G05F 1/10* (2006.01)

(52) U.S. Cl. ..... 327/534; 327/540

(58) Field of Classification Search ..... 327/543, 327/540, 541

See application file for complete search history.

(56) References Cited

U.S. PATENT DOCUMENTS

| | | | | |
|---|---|---|---|---|
| 6,492,864 | B2 * | 12/2002 | Mahrla | 327/540 |
| 6,737,910 | B2 * | 5/2004 | Kitagawa et al. | 327/541 |
| 7,642,818 | B1 * | 1/2010 | Koike | 327/108 |
| 7,751,157 | B2 * | 7/2010 | Migliavacca | 361/18 |
| 7,764,113 | B2 * | 7/2010 | Ryu et al. | 327/541 |

* cited by examiner

*Primary Examiner* — Hai L Nguyen

(74) *Attorney, Agent, or Firm* — Alexander J. Neudeck; Cochran Freund & Young LLC

(57) ABSTRACT

Disclosed is a bias circuit with a first resistor connected between the supply voltage and a feedback node. Resistors are connected in series between the feedback node and the reference supply voltage. The connections between the resistors define at least one bias voltage. A second resistor is connected between the feedback node and a first drain node. A first field-effect transistor has a first gate node, the first drain node, and a first source node. The gate node is connected to the first supply voltage. A second field-effect transistor has a second gate node, a second drain node, and a second source node. The second drain node is connected to the first source node. The second gate node is connected to the bias voltage. The second source node is connected to an output signal node. The output signal node capable of experiencing an overshoot voltage.

19 Claims, 2 Drawing Sheets

BIAS CIRCUIT SCHEME FOR IMPROVED RELIABILITY IN HIGH VOLTAGE SUPPLY WITH LOW VOLTAGE DEVICE

BACKGROUND OF THE INVENTION

Modern integrated circuits may have multiple power supply voltages. In particular, modern integrated circuits may have one power supply voltage used to power most of the internal circuitry and another to power the output circuitry. Typically, the output circuitry is powered by a higher power supply voltage than the internal circuitry. This allows the output circuitry to produce output voltage swings that are compatible with a variety of logic families. It also helps ensure that the output voltage swings are large enough to be received even in the presence of significant external noise.

To increase switching speed and to reduce power consumption, the internal circuitry of an integrated circuit may utilize so-called low voltage field-effect transistors (FETs) that are designed to work well with the lower (internal) power supply voltage. However, these low voltage FETs may suffer from degraded reliability the longer they are exposed to the higher voltages that may be present in output circuitry.

SUMMARY OF THE INVENTION

An embodiment of the invention may therefore comprise a bias circuit, comprising: a supply voltage and a reference supply voltage; a first resistor connected between said supply voltage and a feedback node; a plurality of resistors connected in series between said feedback node and said reference supply voltage, said connections between said plurality of resistors defining at least one bias voltage; a second resistor connected between said feedback node and a first drain node; a first field-effect transistor having a first gate node, said first drain node, and a first source node, said gate node connected to said first supply voltage; and, a second field-effect transistor having a second gate node, a second drain node, and a second source node, said second drain node being connected to said first source node, said second gate node connected to said bias voltage, and said second source node connected to an output signal node, said output signal node capable of experiencing an overshoot voltage.

An embodiment of the invention may therefore further comprise a bias voltage generation circuit, comprising: a first resistive element connected to a first supply voltage and a first node; a second resistive element connected to said first node and a second node, said second node providing a first bias voltage; a third resistive element connected to said second node and a third node, said third node providing a second bias voltage; a fourth resistive element connected to said third node and a second supply voltage; a first field-effect transistor (FET) having a first gate, a first source, and a first drain, said first gate being connected to said third node, said first source being connected to an output that can exceed the first supply voltage, said first drain being connected to a fifth node; a second FET having a second gate, a second source, and a second drain, said second gate being connected to said first supply voltage, said second source being connected to said fifth node, said second drain being connected to a sixth node; and, a fifth resistive element connected to said sixth node and said third node.

An embodiment of the invention may therefore further comprise a bias and output circuit, comprising a supply voltage and a reference supply voltage; a first resistor connected between said supply voltage and a feedback node; a plurality of resistors connected in series between said feedback node and said reference supply voltage, said connections between said plurality of resistors defining a first bias voltage and a second bias voltage; a second resistor connected between said feedback node and a first drain node; a first field-effect transistor having a first gate node, said first drain node, and a first source node, said gate node connected to said first supply voltage; a second field-effect transistor having a second gate node, a second drain node, and a second source node, said second drain node being connected to said first source node, said second gate node connected to said first bias voltage, and said second source node connected to an output signal node, said output signal node capable of experiencing an overshoot voltage; a third field-effect transistor having a third gate node, a third drain node, and a third source node, said third gate node connected to said first bias voltage and said third drain node connected to said output signal node; and, a fourth field-effect transistor having a fourth gate node, a fourth drain node, and a fourth source node, said fourth gate node connected to said second bias voltage and said fourth drain node connected to said output signal node.

DETAILED DESCRIPTION OF THE EMBODIMENTS

In an embodiment, the stress voltage that output circuit transistors are exposed to is reduced. This stress voltage is typically caused by overshoot on a pad node. Reducing this stress is particularly important when a low voltage device is used in a higher supply voltage domain. Thus, the reliability of low voltage transistors used in a higher supply voltage I/O domain is improved.

Figure 1:
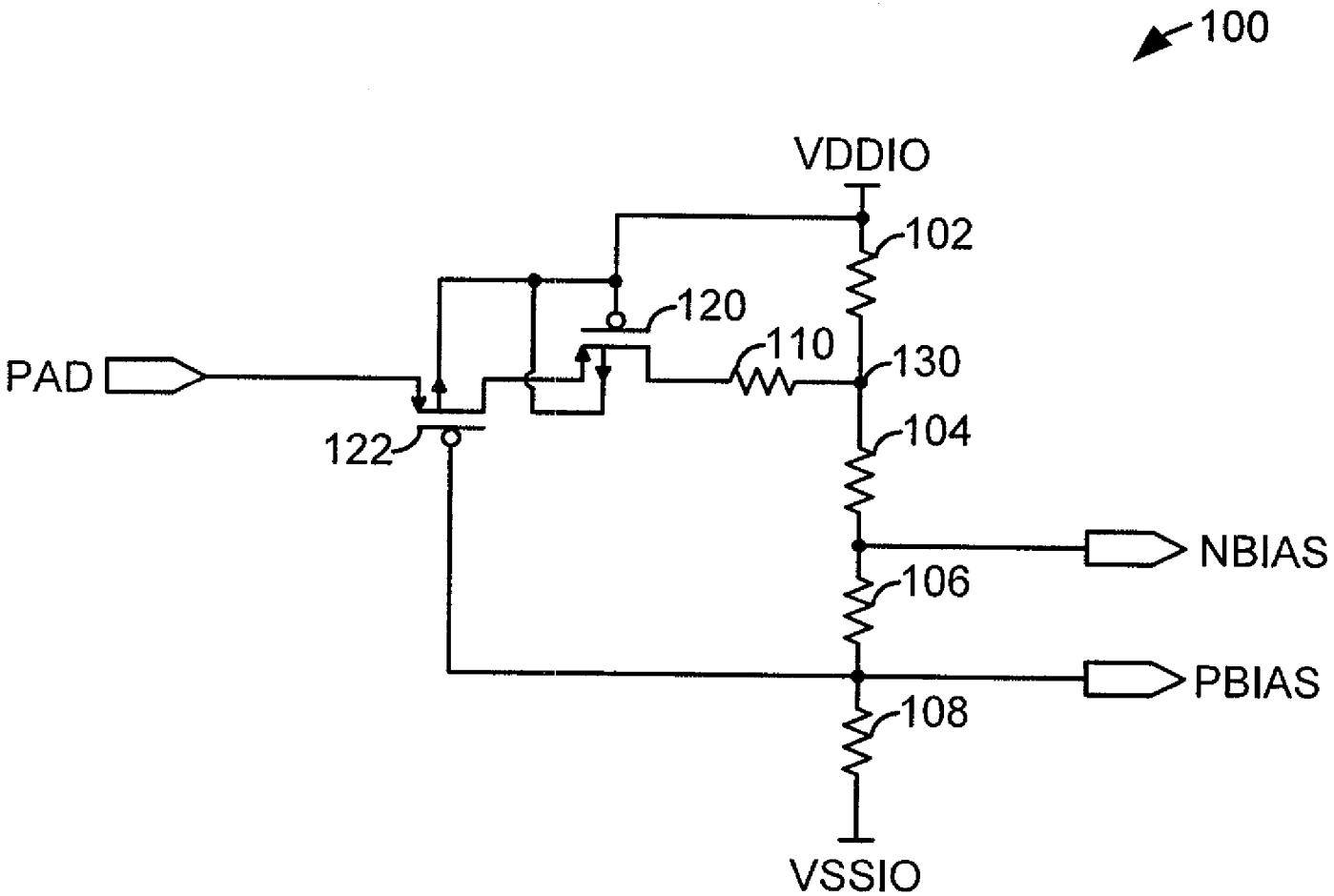
FIG. 1 is a schematic diagram of a bias circuit for improved reliability.

FIG. 1 is a schematic diagram of a bias circuit for improved reliability. Bias circuit 100 comprises: resistor 102, resistor 104, resistor 106, resistor 108, resistor 110, p-channel FET (PFET) 120, and PFET 122. Resistor 102 is connected between a first I/O supply voltage (VDDIO) and a feedback node 130. Resistor 104 is connected between feedback node 130 and a first bias voltage node (NBIAS). Resistor 106 is connected between NBIAS and a second bias voltage node (PBIAS). Resistor 108 is connected between PBIAS and an I/O reference supply voltage (VSSIO).

Resistor 110 is connected between feedback node 130 and the drain of PFET 120. The gate of PFET 120 is connected to VDDIO. The source of PFET 120 is connected to the drain of PFET 122. The gate of PFET 122 is connected to PBIAS. The source of PFET 120 is connected to an output node (PAD). The substrates of PFET 120 and 122 are connected to VDDIO.

In an embodiment, PFETs 120 and 122 are low voltage devices. PFETs 120 and 122 may have a threshold voltage of $V_{tp}$≈0.45V. Resistors 102 and 104 may be approximately 2 kΩ. Resistor 106 may be approximately 800Ω. Resistor 108 may be approximately 4 kΩ. Resistor 110 may be approximately 2.8 kΩ. PFET 120 may have a width to length (W/L) ratio of approximately 133. PFET 122 may have a W/L ratio of approximately 50. VDDIO may be typically 3.3V or 2.5V. VSSIO may be typically 0.0V. Thus, when either PFET 120 or 122 is off (i.e., not conducting) NBIAS is approximately 1.8V. PBIAS is approximately 1.5V.

In normal operation PFET 122 is on. Thus, the voltage on PAD is passed through to the source of PFET 120. When the voltage on PAD exceeds VDDIO+$V_{tp}$ due to noise (e.g., overshoot), PFET 120 begins to turn on. This allows current to flow into feedback node 130 from PAD via PFET 122, PFET 120, and resistor 110. This causes the voltages on NBIAS and PBIAS to increase. The increased NBIAS and PBIAS voltages may be used to help reduce stress on output driver devices. Stress may be defined as voltages across any two terminals of a FET that exceed a predefined stress voltage. The predefined stress voltage is a voltage that it has been determined starts to cause degradation of a FET. In an example, a predefined stress voltage for the low voltage devices PFET 120 and 122 may be 1.98V.

In an example, when PAD overshoots to 4.3 volts, NBIAS and PBIAS may initially rise with the overshoot due to parasitic capacitances between PAD and NBIAS and PBIAS, respectively. Since PAD is now more than VDDIO+$V_{tp}$, PFET 120 starts to conduct. While PFET conducts, PBIAS and NBIAS will be at elevated voltages. For example, PBIAS may be around 1.95V. NBIAS may be around 2.3V.

Note that without PFET 122, PFET 120 would experience a gate-source voltage ($V_{gs}$) that exceeds the predefined stress voltage (e.g., 1.98V). PFET 122 protects PFET 120. If the source of PFET 120 were connected directly to PAD, when PAD is at VSSIO (e.g., 0.0V), the $V_{gs}$ for PFET 120 may be as high as VDDIO=3.3V which is greater than 1.98V. However, with PFET 122's gate tied to PBIAS, then the source of PFET 120 will be approximately PBIAS+$V_{tp}$. In this example, when PAD is at VSSIO=0.0V, then PBIAS is 1.48V and $V_{gs}$ on PFET 120 will be about 1.48+0.45=1.93V. When PAD is overshooting, stress on PFET 120 and PFET 122 typically does not occur.

Figure 2:
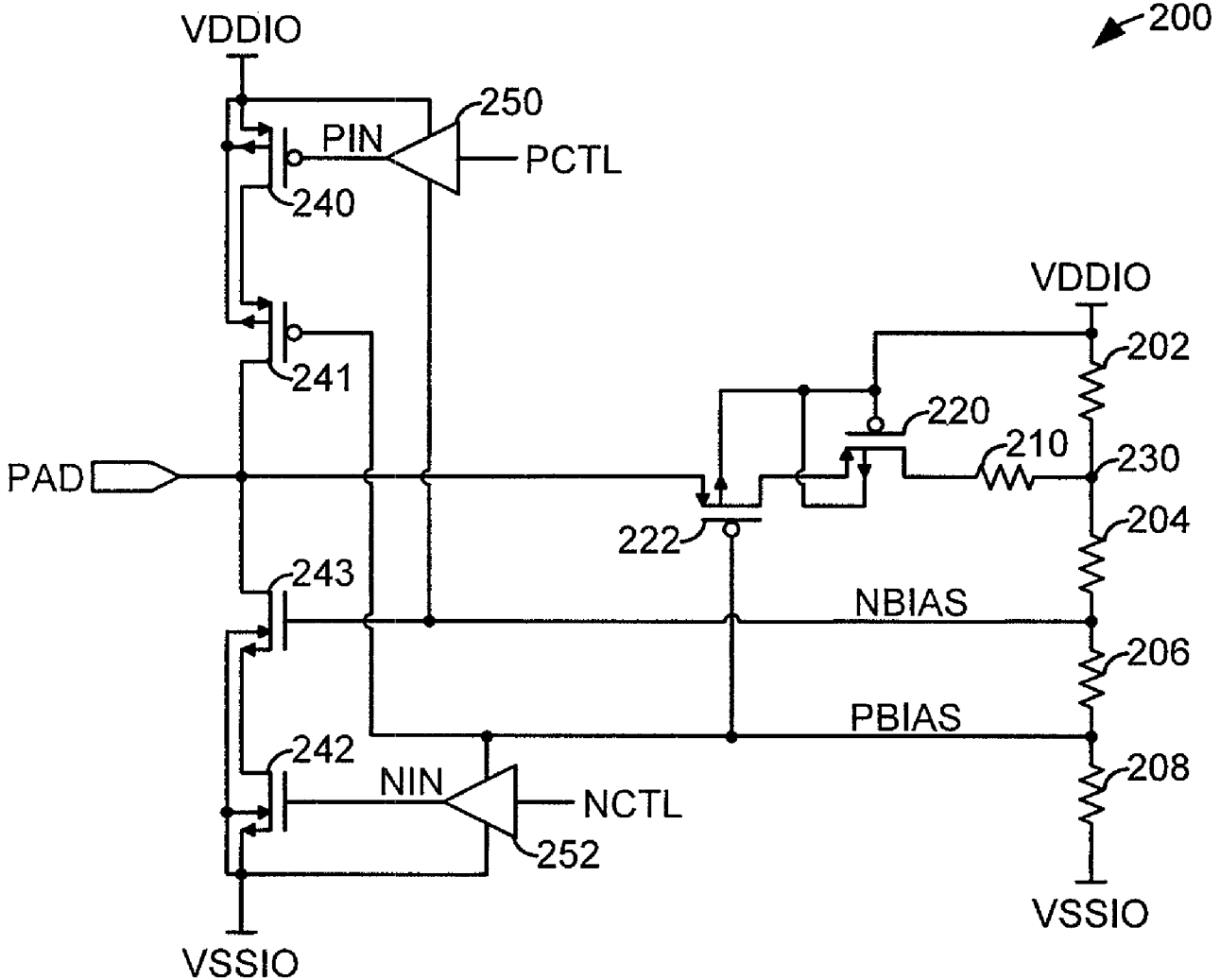
FIG. 2 is a schematic diagram of a bias and output circuit.

FIG. 2 is a schematic diagram of a bias and output circuit. Bias and output circuit 200 comprises: resistor 202, resistor 204, resistor 206, resistor 208, resistor 210, PFET 220, PFET 222, PFET 240, PFET 241, n-channel FET (NFET) 242, NFET 243, predriver 250 and predriver 252. Resistor 202 is connected between a first I/O supply voltage (VDDIO) and a feedback node 230. Resistor 204 is connected between feedback node 230 and a first bias voltage node (NBIAS). Resistor 206 is connected between NBIAS and a second bias voltage node (PBIAS). Resistor 208 is connected between PBIAS and an I/O reference supply voltage (VSSIO).

Resistor 210 is connected between feedback node 230 and the drain of PFET 220. The gate of PFET 220 is connected to VDDIO. The source of PFET 220 is connected to the drain of PFET 222. The gate of PFET 222 is connected to PBIAS. The source of PFET 220 is connected to an output node (PAD). The substrates of PFET 220 and 222 are connected to VDDIO.

The source of PFET 240 is connected to VDDIO. The gate of PFET 240 is connected to the output of predriver 250 (PIN). The drain of PFET 240 is connected to the source of PFET 241. The gate of PFET 241 is connected to PBIAS. The drain of PFET 241 is connected to PAD. The source of NFET 242 is connected to VSSIO. The gate of NFET 242 is connected to the output of predriver 252 (NIN). The drain of NFET 242 is connected to the source of NFET 243. The gate of NFET 243 is connected to NBIAS. The drain of NFET 243 is connected to PAD. The substrates of PFETs 240 and 241 are connected to VDDIO. The substrates of NFETs 242 and 243 are connected to VSSIO.

Predriver 250 is supplied with VDDIO and NBIAS. This is to represent that the output of predriver 250 swings between VDDIO and NBIAS in response to input signal PCTL. Predriver 252 is supplied with PBIAS and VSSIO. This is to represent that the output of predriver 252 swings between PBIAS and VSSIO in response to input signal NCTL.

In an embodiment, PFETs 220, 222, 240, and 241 are low voltage devices. Likewise, NFETs 242 and 243 are low voltage devices. PFETs 220, 222, 240, and 241 may have a threshold voltage of $V_{tp}$≈0.45V. NFETs 242 and 243 may have a threshold voltage of $V_{tn}$≈0.45V. Resistors 202 and 204 may be approximately 2 kΩ. Resistor 206 may be approximately 800Ω. Resistor 208 may be approximately 4 kΩ. Resistor 210 may be approximately 2.8 kΩ. PFET 220 may have a W/L ratio of approximately 133. PFET 222 may have W/L ratio of approximately 50. VDDIO may be typically 3.3V or 2.5V. VSSIO may typically be 0.0V. Thus, when either PFET 220 or 222 is off, NBIAS is approximately 1.8V and PBIAS is approximately 1.5V.

In an example, when PAD sees an overshoot going to 4.3 V, NBIAS and PBIAS will initially follow PAD due to the parasitic capacitance of PFET 241 and NFET 243. When PAD is greater than VDDIO+$V_{tp}$ (e.g., 3.3+0.45=3.75V) PFET 220 will be conducting. This allows current to flow through resistor 210. This current causes NBIAS and PBIAS to elevate. In an example, PBIAS changes to approximately 1.95V and NBIAS changes to approximately 2.3V.

In this example, during the overshoot condition, for NFET 243, $V_{gd}$ is approximately 2.0V and $V_{ds}$ is approximately 2.0+$V_{tn}$=2.45V. For PFET 241, $V_{gs}$ and $V_{gd}$ is approximately 2.3V. For PFET 222, $V_{gs}$ and $V_{gd}$ is approximately 2.3V. While these voltages may be greater than a predefined stress voltage of 1.98V, at least some of them are an improvement when compared to keeping NBIAS and PBIAS static at 1.8V and 1.5V, respectively. Keeping NBIAS and PBIAS static would stress at least PFET 241 with a $V_{gd}$=4.3-1.5=2.8V and NFET 243 with a $V_{gd}$=4.3-1.8=2.5V. Thus, the bias and output circuit 200 has improved reliability by reducing the amount of stress (i.e., the amount of overvoltage and the amount of time the overvoltage is experienced) that low voltage FETs are exposed to during overshoot conditions. In addition, since NBIAS and PBIAS are generated from VDDIO, less stress will be experienced by PFET 241 and NFET 243 when VDDIO is 0.0 and there is a voltage input on PAD that exceeds the predefined stress voltage.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A bias circuit, comprising:

a supply voltage and a reference supply voltage;

a first resistor connected between said supply voltage and a feedback node;

a plurality of resistors connected in series between said feedback node and said reference supply voltage, said connections between said plurality of resistors defining at least one bias voltage;

a second resistor connected between said feedback node and a first drain node;

a first field-effect transistor having a first gate node, said first drain node, and a first source node, said first gate node connected to said supply voltage;

a second field-effect transistor having a second gate node, a second drain node, and a second source node, said second drain node being connected to said first source node, said second gate node connected to said bias voltage, and said second source node connected to an output signal node, said output signal node capable of experiencing an overshoot voltage, said first field-effect transistor and said second field-effect transistor are of a first type.

2. The bias circuit of claim 1, wherein said first field-effect transistor and said second field-effect transistor are p-channel field-effect transistors.

3. The bias circuit of claim 1, wherein said first field-effect transistor and said second field-effect transistor are n-channel field-effect transistors.

4. The bias circuit of claim 1, wherein said at least one bias voltage further comprises a second bias voltage.

5. The bias circuit of claim 4, wherein said bias voltage determines a first gate bias voltage connected to a third gate of a third field-effect transistor having a third drain node, said third drain node being connected to said output signal node.

6. The bias circuit of claim 5, wherein said second bias voltage determines a second gate bias voltage connected to a fourth gate of a fourth field-effect transistor having a fourth drain node, said fourth drain node being connected to said output signal node.

7. A bias voltage generation circuit, comprising:

a first resistive element connected to a first supply voltage and a first node;

a second resistive element connected to said first node and a second node, said second node providing a first bias voltage;

a third resistive element connected to said second node and a third node, said third node providing a second bias voltage;

a fourth resistive element connected to said third node and a second supply voltage;

a first field-effect transistor (FET) having a first gate, a first source, and a first drain, said first gate being connected to said third node, said first source being connected to an output that can exceed the first supply voltage, said first drain being connected to a fifth node;

a second FET having a second gate, a second source, and a second drain, said second gate being connected to said first supply voltage, said second source being connected to said fifth node, said second drain being connected to a sixth node; and, a fifth resistive element connected to said sixth node and said first node.

8. The circuit of claim 7, wherein said first FET and said second FET are n-channel type FETs.

9. The circuit of claim 7, wherein said first FET and said second FET are p-channel type FETs.

10. The circuit of claim 7, wherein said first bias voltage sets a voltage on a third gate of a third FET, a third drain of said third FET being connected to said output.

11. The circuit of claim 7, wherein said second bias voltage sets a voltage on a third gate of a third FET, a third drain of said third FET being connected to said output.

12. The circuit of claim 7, wherein said first bias voltage sets a first voltage on a third gate of a third FET, a third drain of said third FET being connected to said output, said second bias voltage sets a second voltage on a fourth gate of a fourth FET, and a fourth drain of said fourth FET being connected to said output.

13. A bias and output circuit, comprising:

a supply voltage and a reference supply voltage;

a first resistor connected between said supply voltage and a feedback node;

a plurality of resistors connected in series between said feedback node and said reference supply voltage, said connections between said plurality of resistors defining a first bias voltage and a second bias voltage;

a second resistor connected between said feedback node and a first drain node;

a first field-effect transistor having a first gate node, said first drain node, and a first source node, said first gate node connected to said supply voltage;

a second field-effect transistor having a second gate node, a second drain node, and a second source node, said second drain node being connected to said first source node, said second gate node connected to said first bias voltage, and said second source node connected to an output signal node, said output signal node capable of experiencing an overshoot voltage;

a third field-effect transistor having a third gate node, a third drain node, and a third source node, said third gate node connected to said first bias voltage and said third drain node connected to said output signal node; and, a fourth field-effect transistor having a fourth gate node, a fourth drain node, and a fourth source node, said fourth gate node connected to said second bias voltage, said fourth drain node connected to said output signal node.

14. The bias and output circuit of claim 13, wherein said first field-effect transistor, said second field-effect transistor, and said third field-effect transistor are of a first type.

15. The bias and output circuit of claim 13, wherein said first field-effect transistor, said second field-effect transistor, and said third field-effect transistor are p-channel field-effect transistors.

16. The bias and output circuit of claim 13, wherein said first field-effect transistor, said second field-effect transistor, and said third field-effect transistors are n-channel field-effect transistors.

17. The bias and output circuit of claim 13, further comprising:

a fifth field-effect transistor having a fifth gate node, a fifth drain node, and a fifth source node, said fifth gate node connected to a first predriver output that swings between said second bias voltage and said first supply voltage, said fifth drain node connected to said third source node, and said fifth source node connected to said first supply voltage; and, a sixth field-effect transistor having a sixth gate node, a sixth drain node, and a sixth source node, said sixth gate node connected to a second predriver output that swings between said first bias voltage and said reference supply voltage, said sixth drain node connected to said fourth source node, and said sixth source node connected to said reference supply voltage.

18. The bias and output circuit of claim 17, wherein said first, second, third, and fifth field-effect transistors are p-channel field-effect transistors.

19. The bias and output circuit of claim 17, wherein said first, second, third, and fifth field-effect transistors are n-channel field-effect transistors.

* * * * *